US006091061A

United States Patent [19]

Dreisler et al.

[11] Patent Number: 6,091,061

[45] Date of Patent: Jul. 18, 2000

[54] SYSTEM FOR REDUCING RADIAL LEAKS IN A REGENERATIVE AIR HEATER FOR THERMAL EQUIPMENT

[75] Inventors: Philippe Dreisler, Velizy; Paul Francin, Nomain; Jean-Claude Semedard, Paris, all of France

[73] Assignee: Alstom Energy Systems SA, Velizy-Villacoublay

[21] Appl. No.: 09/241,311

[22] Filed: Feb. 1, 1999

[30] Foreign Application Priority Data

Feb. 2, 1998 [FR] France ..... 98 01136

[51] Int. Cl.[7] ..... H05B 1/02

[52] U.S. Cl. ..... 219/494; 219/501; 165/6; 165/8; 165/DIG. 60; 165/DIG. 17

[58] Field of Search ..... 219/494, 505, 219/501, 497, 499; 165/8–9, 6, 82, DIG. 17, DIG. 60, DIG. 539, 11.1

[56] References Cited

U.S. PATENT DOCUMENTS

| | | | |
|---|---|---|---|
| 3,088,518 | 5/1963 | Rayburn . | |
| 4,124,063 | 11/1978 | Stockman . | |
| 4,301,858 | 11/1981 | Mock . | |
| 4,823,861 | 4/1989 | Warrick | 165/9 |
| 5,513,695 | 5/1996 | Harting | 165/8 |

FOREIGN PATENT DOCUMENTS

| | | |
|---|---|---|
| 0 137 670 A2 | 4/1985 | European Pat. Off. . |
| 2 445 503 | 7/1980 | France . |
| 60-251391 | 12/1985 | Japan . |
| 62-166292 | 7/1987 | Japan . |
| 1 412 872 | 11/1975 | United Kingdom . |

*Primary Examiner*—Mark Paschall
*Attorney, Agent, or Firm*—Sughrue, Mion, Zinn, Macpeak & Seas, PLLC

[57] ABSTRACT

The invention relates to a system for reducing radial leaks in an air heater for thermal equipment, the heater being of the type including a rotor fitted with a plurality of heater elements supported by diaphragms, a stator constituted by a leakproof metal case, and radial sealing means including hinged sector plates positioned over the heater elements together with radial gaskets provided on the diaphragms. The system has a mechanical mechanism for acting on the functional clearance that exists between each sector plate and the radial gaskets, wherein said mechanical mechanism is controlled by a regulation mechanism connected to information gathering mechanism for providing information about the operating rate of the thermal equipment, wherein the regulation mechanism continuously imposes a position for each plate relative to the radial gaskets, wherein the regulation mechanism determines the relative position based on a relationship between deformation of the sector plates and an operating rate of the thermal equipment as conveyed by the information gathering mechanism.

15 Claims, 4 Drawing Sheets

SYSTEM FOR REDUCING RADIAL LEAKS IN A REGENERATIVE AIR HEATER FOR THERMAL EQUIPMENT

The present invention relates to thermal equipment and more specifically to a system for reducing the radial leaks that can appear in air heaters installed on thermal equipment and used for heating the combustion air delivered to such equipment by heat exchange with the hot flue gases taken from the outlet thereof.

BACKGROUND OF THE INVENTION

A particular application of the invention lies in regenerative air heaters of the Ljungstroem (trade name) type.

Such air heaters are mainly constituted by:

rotor in which there are installed a plurality of heater elements (preferably constituted by corrugated metal sheets) supported by radially-extending metal plates (diaphragms) defining a plurality of radial sectors, said heater element having flows of air and of flue gases passing through them in alternation;

a stator constituted by a leakproof metal case to which the air and flue-gas ducts are connected; and sealing means restricting the leakage of air into the flue gases and comprising a plurality of sector plates secured to said stator and positioned over said heater elements, together with radial gaskets provided on the diaphragms.

Because of their heat exchange function, regenerative air heaters convey fluid flows at temperatures that vary, since the flue gases cool down to give heat to the air which heats up. As a result, the diaphragms supporting the heaterfelerents take up a mean temperature that also varies, resulting from the heat exchange between the two fluids and thus being subjected to differential thermal expansions which have the effect of causing the rotor to take up an umbrella shape. The sealing devices seeking to restrict the flow of air into the flue gases must therefore track the deformations of the rotor since otherwise the increasing clearance between the rotor and the sector plates will give rise to unacceptable levels of radial leakage.

The leakproofing of the system is quantified by the value of the functional clearance that exists between the sector plates and the radial gaskets of the diaphragms. In order to maintain minimum functional clearance between the sector plates and the radial gaskets fitted to the diaphragms, and in order to do so regardless of the extent to which the rotor is deformed, air heaters in the state of the art are conventionally provided with a system for taking up the functional clearance by acting on the position of the sector plates relative to the stator. By means of such a system, the sector plates are periodically actuated for the purpose of controlling the above-mentioned functional clearance and for simultaneously controlling the radial leaks that can result from an increase thereof.

More precisely, the take-up system in question is constituted by a mechanism secured to the stator made up of an electric motor associated with a gearbox and with an angle drive mechanism acting, via rods, on the position of each sector plate relative to the stator. The action of the mechanism on the outer end of each sector plate is to subject it to an angular displacement. For this purpose, the inner ends of the sector plates are hinged to the shaft of the rotor. In order to maintain substantially constant functional clearance between the sector plates and the radial gaskets, it is necessary to track the relative deformations of the stator/rotor assembly. This tracking is provided by a position detector which periodically detects the relative position of these elements and which thus makes it possible to control lowering and raising of the sector plates via electrical contacts in order to maintain optimum functional clearance.

In the state of the art, the system for taking up clearance measures the relative clearance generated by differential thermal expansion between the sector plates and the rotor which by means of a position detector (with associated electrical contacts) suffers from the drawback of constituting an element that is extremely sensitive.

Such a detector operates under particularly severe conditions characterized by high temperature, a corrosive atmosphere due in particular to the presence of sulfur, the presence of flue gases charged with abrasive ash, and the presence of particles that may be adhesive. It is therefore subject to its operation being degraded by such an environment.

This problem is made worse by the fact that the displacements are periodic and of very small amplitude (a few millimeters). Failure of this member which is subject to jamming or blocking can cast doubt on the usefulness of the entire operation of the radial leak reducing system and can even give rise to severe damage to the air heater when the radial gaskets scrape against a sector plate that has not been raised.

Furthermore, in such a system, continuously measuring the relative clearance between the sector plates and the radial gaskets fitted to the diaphragms is not an option that can be considered, since under such circumstances the wear on the end of the feeler rod and/or on the contact surface of the rotor would be much too fast.

OBJECTS AND SUMMARY OF THE INVENTION

The object of the present invention is to provide an active system for reducing radial leaks in regenerative air heaters while avoiding the above drawbacks.

In particular, an object of the invention is to describe such a system that presents improved reliability.

Another object of the present invention is to describe such a system which enables optimum clearance to be maintained on a continuous basis between the sector plates and the radial gaskets fitted to the diaphragms, while also providing greater flexibility of adjustment than is provided by the state of the art system.

Another object of the invention is to propose such a system which makes it possible to simplify maintenance operations on a device of this type.

Finally, another object of the invention is to describe such a system which makes manufacture of the air heater simpler.

These various objects are achieved by the invention which provides a system for reducing the radial leaks that can appear in a heater used for heating air being fed to thermal equipment, such as a boiler, by exchanging heat with hot flue gases taken from the outlet of said thermal equipment, the system being of the type comprising:

a rotor fitted with a plurality of heater elements supported by radial metal plates that form diaphragms, said heater elements having flows of air and of flue gases passing through them in alternation;

a stator constituted by a leakproof metal case having air and flue-gas ducts connected thereto; and radial sealing means restricting the leakage of air into the flue gases and comprising a plurality of sector plates hinged to the shaft of the rotor and positioned over said heater elements together with radial gaskets provided on the diaphragms;

the system further comprising mechanical means for acting on the operating clearance that exists between each sector plate and said radial gaskets, and wherein said mechanical means are controlled by regulation means connected to information means providing information about the operating rate of the thermal equipment, said regulation means including a relationship concerning deformation of the sector plates making it possible continuously to impart a relative position to each sector plate relative to said radial gaskets as a function of the information provided by said information means.

The system of the invention thus proposes eliminating the position detector (feeler or sensor) of the above-described system known in the state of the art and acting on the mechanical means for regulating the clearance which exists between the sector plates and the radial gaskets by relying on taking account of the thermal expansion to which it is assumed that the various component elements of the air heater will have been subjected. According to the invention, the displacement of each sector plate obeys a deformation relationship which continuously maintains constant functional clearance as a function of the operating rate of the thermal equipment. To this end, the regulation means are continuously informed about the operating rate of the equipment, which rate is representative of the differential thermal expansions, and they continuously impose a relative position on each sector plate in application of the deformation relationship integrated in the regulation means.

In order to take account of phenomena associated with thermal inertia of the air heater due to its mass (several hundred tons) and which have a direct influence on diaphragm deformation, said regulation means of the system of the invention preferably include means enabling their action on said mechanical means to be deferred by a time t which is a function of said phenomena.

Also preferably, said regulation means include a filter for clipping peaks from interfering variations in operating rate as provided by staid means for providing information about the rate of operation of the thermal equipment.

The displacement relationship used by said regulation means in accordance with the invention is defined for each air heater as a function of the following parameters:

the geometrical characteristics of the rotor;

the thermal expansion coefficients of the metals constituting the diaphragms of the air heater; and the temperature difference of the diaphragms between the inlet and the outlet of the air heater.

Since these respective temperatures are known as a function of the operating rate of the thermal equipment, deformation is then determined for a given air heater as a function either of the temperatures of the flue gas at the inlet to and at the outlet from the air heater, or as a function of the temperatures of the air at the inlet to and at the outlet from the air heater, or directly as a function of the operating rate, or else as a combination of the above parameters, making it possible to take account of a set of secondary phenomena.

In practice, deformation is determined for two extreme rates of operation in association with performance guarantees, specifically a maximum rate (e.g. 100%) and a minimum rate (e.g. 40%), and between those two rates, said displacement relationship that is used by the regulation means is given by the following formula:

$$disp.=A\times\Delta T\times H\times D^2/8$$

in which: A represents the thermal expansion coefficient of the metal constituting the diaphragms, $\Delta T$ represents the temperature variation of said metal between the inlet and the outlet of the air heater, D represents the diameter of the rotor, and H represents the height of the rotor. This relationship thus ensures that the positioning of each sector plate is continuously regulated as a function of the rate at which the thermal equipment is operating over a normal operating range. Outside this range, the system returns the sector plate to its position in a "thermal equipment stopped, rotor non-deformed" setting.

According to another preferred aspect of the invention, said regulation means are in the form of at least one unit that is offset away from the air heater. In such a preferred variant, the unit is thus not itself subjected to the severe ambient conditions in which the position detector and the electrical contacts of state of the art systems are to be found.

Advantageously, said mechanical means of the system of the invention include an electrical servo-motor with an integrated gearbox acting via a plurality of angle drives on rods that are connected to each of the sector plates.

Also advantageously, said rods are guided in bearings lined with respective graphite rings.

In present systems, the suspension rods enabling the sector plates to be secured to the structure of the air heater are guided by guide sheaths having packing. To accommodate the differential expansion differences that exist between the sector plate and the structure, it is necessary to provide a large amount of clearance between the sheath and the suspension rod. To prevent the system jamming, it is also necessary to provide abundant lubrication (manual action recommended every 2 weeks) using anti-jamming products that are suitable for high temperature use. Unfortunately, such anti-jamming products react with the corrosive ambient atmosphere and crystallize very quickly. To keep such a system in operation, it is necessary to remove the crystals that have formed each time it is lubricated, and in practice that is not possible. Thus, after several months of operation, the mechanism jams and it is impossible to make the leak control system operate properly.

By using bearings lined with graphite rings in accordance with the invention that enable dry lubrication to be performed, it is possible to avoid lubrication operations. In addition, the suspension rods are advantageously coated in respective layers of anti-corrosion and anti-wear alloy (nickel and tungsten carbide deposited by melting) making it possible to avoid phenomena of corrosion and jamming, thereby considerably improving the reliability of the system.

BRIEF DESCRIPTION OF THE DRAWINGS

The invention and the various advantages thereof will be understood more easily on reading the following description of a non-limiting embodiment of the invention given with reference to the accompanying drawings, in which.

MORE DETAILED DESCRIPTION

Figure 1:
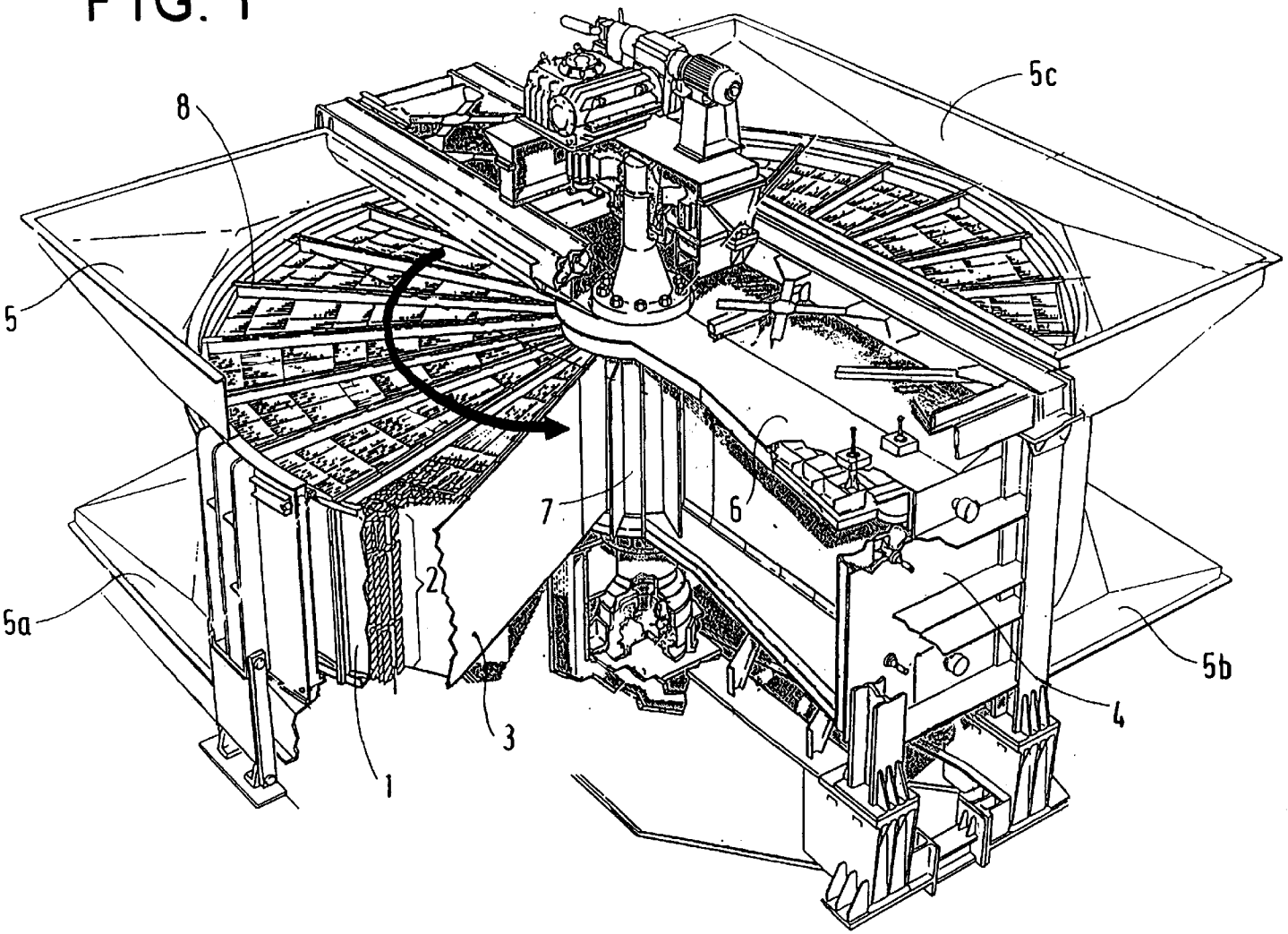
FIG. 1 is an exploded perspective view of a Ljungstroem type regenerative air heater, in particular for a boiler, and fitted with a leak reduction system of the invention.

FIG. 1 shows the overall architecture of a Ljungstroem type air heater.

This type of air heater is essentially constituted by a rotor 1 mounted on a shaft 7 and moving inside a stator 4 which is in the form of a sealed enclosure.

The stator is provided with ducts 5, 5*a*, 5*b*, and 5*c* respectively for delivering hot flue gases from combustion in a boiler, for removing cooled flue gases, and for delivering and removing the air that is to be heated.

The rotor is fitted with a plurality of heater elements 2 made of corrugated metal sheets, and continuous flows of flue gases and of combustion air pass through the heater elements which serve to transfer heat from one of the fluids to the other. These heater elements are distributed in compartments that are defined by metal plates that are mounted radially to form diaphragms 3 and that are provided at their top edges with respective radial gaskets 8.

In order to provide the heater with radial sealing, "sector" plates 6 are positioned above the heater elements and are hinged to the shaft 7 of the rotor 1. These plates 6 co-operate with gaskets 8 to define functional clearance whose value is to be maintained at a reference value in order to eliminate the risk of radial leaks. For this purpose, the heater is fitted with a system enabling said sector plates 6 to be displaced, which displacements are made possible by the hinges, 19 fitted to the plates 6. This system constitutes the subject matter of the invention and is described in greater detail below with reference to FIGS. 2 and 3.

Figure 2:
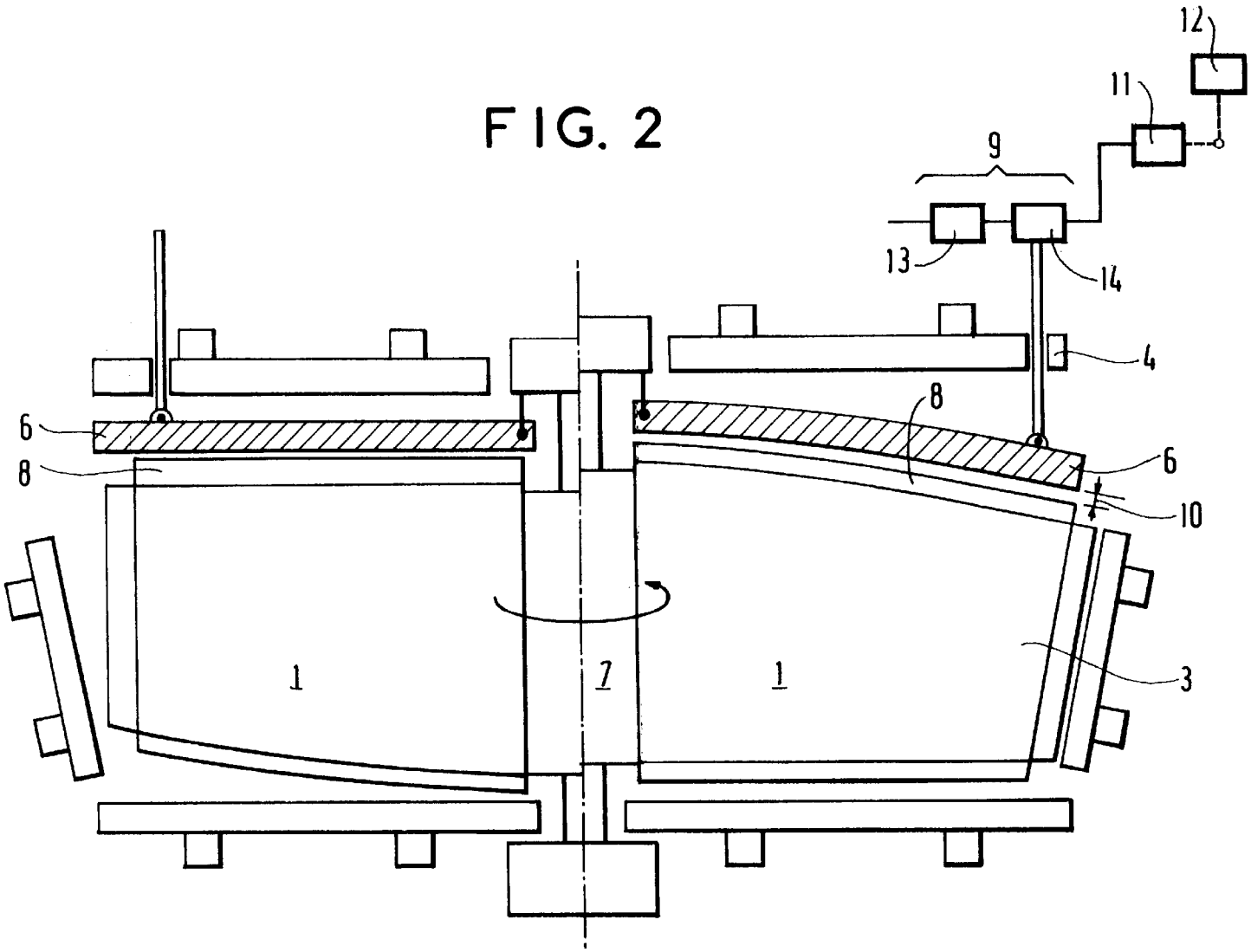
FIG. 2 is a section view of the air heater shown in FIG. 1.
Figure 3:
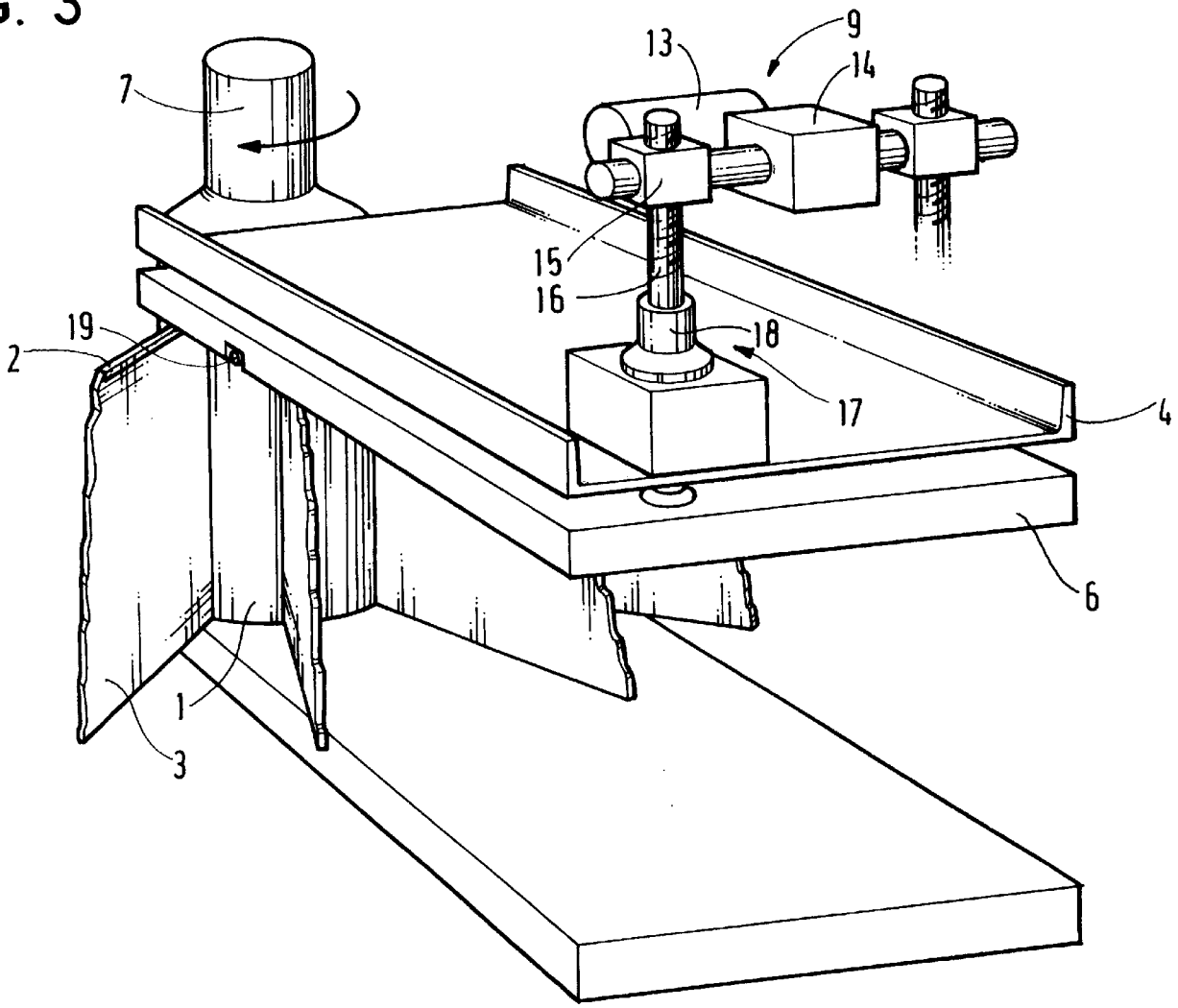
FIG. 3 is a detail view of a portion of the active radial leak reducing system of the invention.

With reference to FIG. 2, where the left-hand half shows the sector plates 6 in the position they occupy relative to the diaphragms 3 when cold, while the right-hand half shows the sector plates 6 in the position they take up relative to the diaphragms 3 when hot, the diaphragms 3 supporting the heater elements adopt a mean temperature that varies as a result of the heat exchange between the two fluids, and they are therefore subjected to differential thermal expansion with the consequence of imparting an umbrella shape to the rotor. This variation in the positioning of the diaphragms 3 depends on their temperature and thus on the operating rate of the boiler.

In accordance with the invention, in order to control the clearance 10 between the sector plates 6 and the radial gaskets 8 fitted to the diaphragms 3, the heater is fitted with mechanical means 9 connected to regulation means 11 which are themselves connected to information means 12 providing information about the operating rate of the boiler. These regulation means implement a displacement relationship for the sector plates 6 that makes it possible on a continuous basis to impose a given position on each sector plate 6 relative to said radial gaskets 8 as a function of the information provided by said information means 12.

The regulation means 11 are in the form of a unit that is offset from the heater so as to avoid being subjected to the particularly severe operating conditions thereof.

The information means 12 providing information about the operating rate of the boiler are designed either to measure the operating rate of the boiler directly, or to measure the inlet and outlet temperatures of the flue gases, or to measure the inlet and outlet temperatures of the air, or else to operate on a combination of these parameters. All of these parameters are representative of variations in the temperatures of diaphragms 3 and consequently of the deformation to which said elements are subjected and that might alter the clearance 10 between the sector plates 6 and the diaphragms and thus the gaskets fitted to the diaphragms.

More precisely, the mechanical means 9 include (see FIG. 3) an electrical servo-motor 13 with an integrated gearbox 14 acting, via a plurality of angle drives 15, on rods 16 connected to each of the sector plates 6.

In order to facilitate maintenance of these mechanical means 9, said rods 16 are guided in bearings 17 that are lined with respective graphite rings 18.

Figure 4:
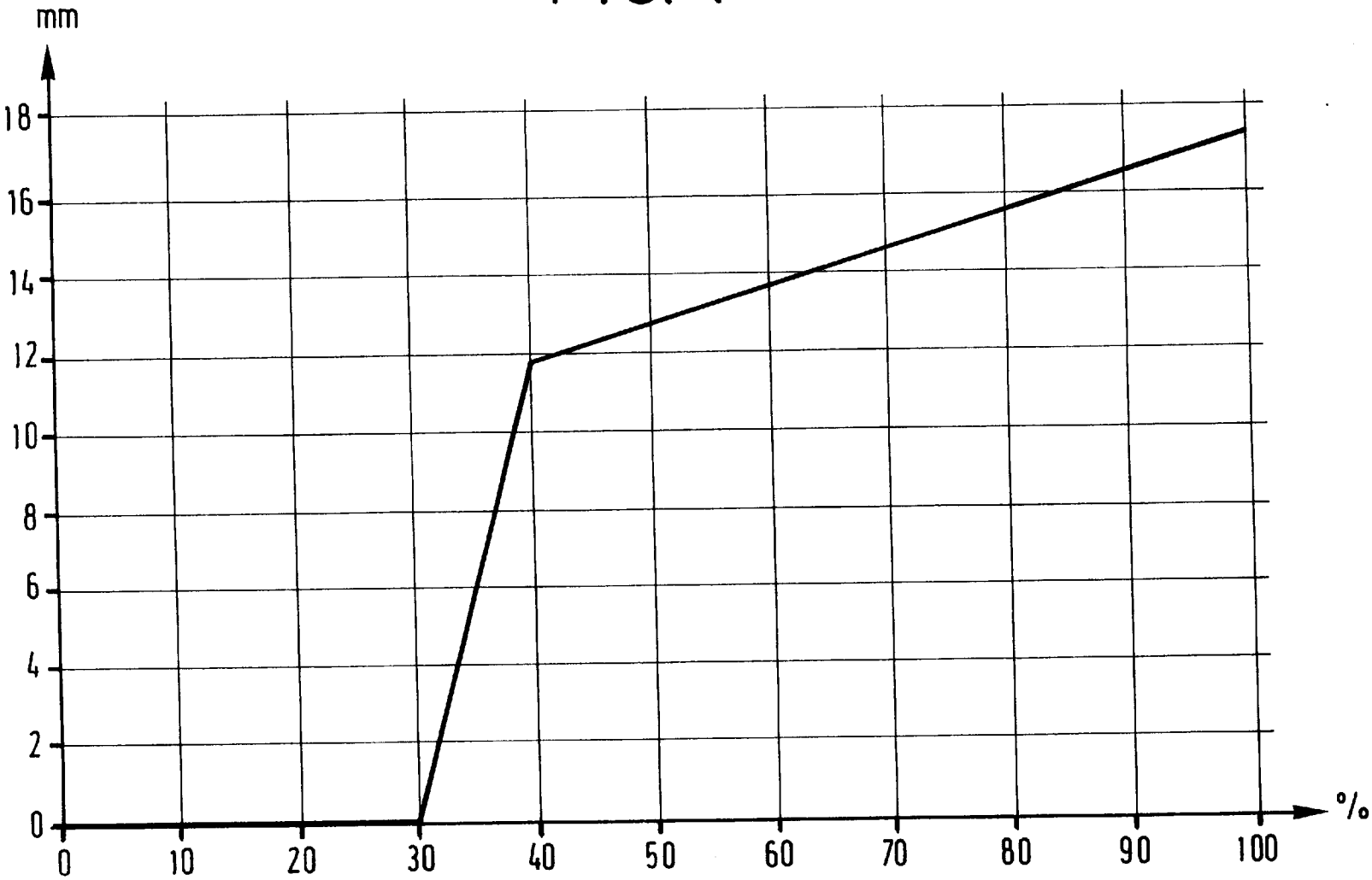
FIG. 4 is a graph showing the displacement of a sector plate of the air heater shown in FIGS. 1 and 2 for the purpose of maintaining constant operating clearance, plotted as a function of boiler load.

By implementing the means of the invention, it is possible to displace the sector plates 6 automatically as a function of the boiler operating rate and thus to avoid making use of any displacement feeler or sensor as recommended in the prior art. The graph of FIG. 4 gives an example of the displacements of the sector plates 6 stemming from an increase in the operating rate of the boiler.

It will be observed that to avoid certain instabilities of the system of the invention, the system should not be brought into operation suddenly on reaching the minimum operating rate, but should rather be brought into operation (and taken out of operation) progressively over a transitional period corresponding to a 10% change in operating rate (in the present example this occurs over the range 30% to 40%).

It should also be observed that in order to take account of phenomena associated with the thermal inertia of the air heater due to its mass and which have a direct influence on diaphragm deformation, the regulation means 11 of the system include a delay (not shown) for deferring their action on said mechanical means 9 by a length of time t that is a function of said phenomena.

The system described presents numerous advantages over the system known in the state of the art.

Eliminating the proximity detection system and its associated electrical contacts makes it possible to improve the reliability of the system for reducing radial leaks.

In addition, using the proposed system makes it possible to maintain optimum clearance on a continuous basis while providing greater flexibility of adjustment and while making it possible to take account of deterioration of the radial gaskets by modifying the displacement relationship for each sector plate, which is not possible with the prior art system.

The system of the invention also makes it possible to simplify maintenance operations very considerably by making it possible to use dry lubrication for the bearings that guide the rods.

Finally, eliminating any proximity detection system makes it possible to simplify manufacture of the air heater by omitting any machining operations on the circumferential surface of the rotor where it is supposed to come into contact with the feeler.

The embodiment of the invention described herein is not intended to restrict the scope of the invention. Numerous modifications can therefore be made thereto without going beyond its ambit.

What is claimed is:

1. A system for reducing the radial leaks that can appear in a heater used for heating air being fed to thermal equipment by exchanging heat with hot flue gases taken from the outlet of said thermal equipment, the system being of the type comprising:

a rotor fitted with a plurality of heater elements supported by radial metal plates that form diaphragms, said heater elements having flows of air and of flue gases passing through them in alternation;

a stator constituted by a leakproof metal case having air and flue-gas ducts connected thereto; and radial sealing means restricting the leakage of air into the flue gases and integrating a plurality of sector plates hinged to the shaft of the rotor and positioned over said heater elements together with radial gaskets provided on the diaphragms;

said system further comprising mechanical means for acting on the operating clearance that exists between each sector plate and said radial gaskets, and wherein said mechanical means are controlled by regulation means connected to information means providing information about the operating rate of the thermal equipment, further wherein said information means is devoid of a position detecting means for detecting the relative position of the sector plates and the radial gaskets, and said regulation means continuously imparting a relative position to each sector plate relative to said radial gaskets, wherein said regulating means determines said relative position based on a relationship between deformation of the sector plates and the operating rate of the thermal equipment as provided by said information means.

2. A system according to claim 1, wherein said regulation means include means enabling their action on said mechanical means to be deferred by a time t as a function of the thermal inertia of the heater.

3. A system according to claim 1, wherein said regulation means include a filter for clipping peaks from interfering variations in operating rate as provided by said means for providing information about the rate of operation of the thermal equipment.

4. A system for reducing the radial leaks that can appear in a heater used for heating air being fed to thermal equipment by exchanging heat with hot flue gases taken from the outlet of said thermal equipment, the system being of the type comprising:

a rotor fitted with a plurality of heater elements supported by radial metal plates that form diaphragms, said heater elements having flows of air and of flue gases passing through them in alternation;

a stator constituted by a leakproof metal case having air and flue-gas ducts connected thereto; and radial sealing means restricting the leakage of air into the flue gases and integrating a plurality of sector plates hinged to the shaft of the rotor and positioned over said heater elements together with radial gaskets provided on the diaphragms;

said system further comprising mechanical means for acting on the operating clearance that exists between each sector plate and said radial gaskets, and wherein said mechanical means are controlled by regulation means connected to information means providing information about the operating rate of the thermal equipment, said regulation means continuously imparting a relative position to each sector plate relative to said radial gaskets, wherein said regulating means determines said relative position based on a relationship between deformation of the sector plates and the operating rate of the thermal equipment as provided by said information means, wherein said plate displacement relationship is defined for each air heater as a function of the following parameters: the geometrical characteristics of the rotor; the thermal expansion coefficients of the metals constituting the diaphragms; and the difference between the temperatures of the diaphragms between the air inlet and the air outlet.

5. A system according to claim 4, wherein said means for providing information about the operating rate of the thermal equipment are designed to measure the temperatures of the flue gases at the inlet to and at the outlet from the air heater.

6. A system according to claim 4, wherein said means for providing information about the operating rate of the thermal equipment are designed to measure the temperatures of the air at the inlet to and at the outlet from the air heater.

7. A system according to claim 4, wherein said means for providing information about the operating rate of the thermal equipment are designed to measure the operating rate of the thermal equipment directly.

8. A system for reducing the radial leaks that can appear in a heater used for heating air being fed to thermal equipment by exchanging heat with hot flue gases taken from the outlet of said thermal equipment, the system being of the type comprising:

a rotor fitted with a plurality of heater elements supported by radial metal plates that form diaphragms, said heater elements having flows of air and of flue gases sassing through them in alternation;

a stator constituted by a leakproof metal case having air and flue-gas ducts connected thereto; and radial sealing means restricting the leakage of air into the flue gases and integrating a plurality of sector plates hinged to the shaft of the rotor and positioned over said heater elements together with radial gaskets provided on the diaphragms;

said system further comprising mechanical means for acting on the operating clearance that exists between each sector plate and said radial gaskets, and wherein said mechanical means are controlled by regulation means connected to information means providing information about the operating rate of the thermal equipment, said regulation means continuously imparting a relative position to each sector plate relative to said radial gaskets, wherein said regulating means determines said relative position based on a relationship between deformation of the sector plates and the operating rate of the thermal equipment as provided by said information means, wherein said displacement relationship is expressed, between two extreme operating rates, by the following formula:

$$\text{disp.}=A\times\Delta T\times H\times D^2/8$$

in which: A represents the thermal expansion coefficient of the metal constituting the diaphragms, $\Delta T$ represents the temperature variation of said metal between the inlet and the outlet of the air heater, D represents the diameter of the rotor, and H represents the height of the rotor.

9. A system according to claim 1, wherein said regulation means are in the form of at least one unit that is offset from the air heater.

10. A system according to claim 1, wherein said mechanical means include an electrical servo-motor with an integrated gearbox acting, via a plurality of angle drives, on rods connected to each of the sector plates.

11. A system according to claim 1, wherein said rods are guided by bearings lined with respective graphite rings.

12. A system according to claim 1, wherein said rods are lined in respective layers of anti-corrosion and anti-wear alloy.

13. A system for reducing the radial leaks that can appear in a heater used for heating air being fed to thermal equipment by exchanging heat with hot flue gases taken from the outlet of said thermal equipment, the system being of the type comprising:

a rotor fitted with a plurality of heater elements supported by radial metal plates that form diaphragms, said heater elements having flows of air and of flue gases passing through them in alternation;

a stator constituted by a leakproof metal case having air and flue-gas ducts connected thereto; and a radial sealing device which restricts the leakage of air into the flue gases, said radial sealing device including a plurality of sector plates hinged to the shaft of the rotor and positioned over said heater elements, and radial gaskets provided on the diaphragms;

said system further comprising a mechanical device which changes the operating clearance that exists between each sector plate and said radial gaskets, and wherein said mechanical device is controlled by a regulator connected to a sensor which senses information about the operating rate of the thermal equipment, further wherein said sensor does not include a position detector which detects a relative position of said sector plates and said radial gaskets, and said regulator continuously imparts a relative position to each sector plate relative to said radial gaskets, wherein said regulator determines said relative position based on a relationship between deformation of the sector plates and operating rate of the thermal equipment as provided by said sensor.

14. A system according to claim 13, wherein said plate displacement relationship is defined for each air heater as a function of the following parameters: the geometrical characteristics of the rotor; the thermal expansion coefficients of the metals constituting the diaphragms; and the difference between the temperatures of the diaphragms between the air inlet and the air outlet.

15. A system according to claim 13, wherein said displacement relationship is expressed, between two extreme operating rates, by the following formula:

$$\text{disp.}=A\times\Delta T\times H\times D^2/8$$

in which: A represents the thermal expansion coefficient of the metal constituting the diaphragms, $\Delta T$ represents the temperature variation of said metal between the inlet and the outlet of the air heater, D represents the diameter of the rotor, and H represents the height of the rotor.

* * * * *